US010982460B2

(12) United States Patent
Reusing

(10) Patent No.: US 10,982,460 B2
(45) Date of Patent: Apr. 20, 2021

(54) SUPPORT APPARATUS FOR SUPPORTING A HEADSTONE

(71) Applicant: Goliathtech Inc., Magog (CA)

(72) Inventor: Julian L. Reusing, Magog (CA)

(73) Assignee: GOLIATHTECH INC., Magog (CA)

( * ) Notice: Subject to any disclaimer, the term of this patent is extended or adjusted under 35 U.S.C. 154(b) by 0 days.

(21) Appl. No.: 16/059,618

(22) Filed: Aug. 9, 2018

(65) Prior Publication Data

US 2019/0048611 A1 Feb. 14, 2019

Related U.S. Application Data

(60) Provisional application No. 62/543,700, filed on Aug. 10, 2017.

(51) Int. Cl.

| | |
|---|---|
| ***E04H 13/00*** | (2006.01) |
| ***E04H 9/02*** | (2006.01) |
| ***E04H 12/22*** | (2006.01) |

(52) U.S. Cl.

CPC ..... *E04H 13/003* (2013.01); *E04H 13/001* (2013.01); *E04H 9/021* (2013.01); *E04H 12/2223* (2013.01)

(58) Field of Classification Search

CPC . E04H 12/2276; E04H 12/2284; E04H 13/00; E04H 13/001; E04H 13/003; E02D 27/48; E02D 35/00

See application file for complete search history.

(56) References Cited

U.S. PATENT DOCUMENTS

| | | | | |
|---|---|---|---|---|
| 3,676,965 | A * | 7/1972 | Deike | E02D 5/801 52/157 |
| 4,438,607 | A * | 3/1984 | Nelson | E02D 27/00 52/126.1 |
| 4,738,061 | A | 4/1988 | Herndon | |
| 5,623,792 | A * | 4/1997 | Crumpacker | E02D 27/32 52/103 |
| 5,707,180 | A | 1/1998 | Vickars et al. | |
| 5,800,094 | A * | 9/1998 | Jones | E02D 35/00 254/133 R |
| 7,748,932 | B2 * | 7/2010 | Lindsey | E02D 5/801 405/232 |
| 9,051,706 | B1 * | 6/2015 | Ludwig | E02D 5/76 |
| 9,458,593 | B2 | 10/2016 | Hale | |
| 9,555,658 | B2 | 1/2017 | Busam | |
| 2003/0041535 | A1 | 3/2003 | Rupiper | |

(Continued)

FOREIGN PATENT DOCUMENTS

| | | | | |
|---|---|---|---|---|
| AU | 2013200834 | A1 | 9/2013 | |
| CA | 2369370 | A1 * | 8/2003 | E04H 13/003 |

(Continued)

*Primary Examiner* — Christine T Cajilig

(74) *Attorney, Agent, or Firm* — Snyder, Clark, Lesch & Chung, LLP

(57) ABSTRACT

A support apparatus for supporting a headstone, the apparatus comprising: a pile having a top end and a bottom end; a helical member secured to the bottom end of the pile; and a pile head secured to the top end of the pile, the pile head having a mounting portion engaging the top end of the pile and a holding portion extending away from the mounting portion for engaging a bottom end portion of the headstone to maintain the headstone in a vertical orientation.

16 Claims, 14 Drawing Sheets

(56) References Cited

U.S. PATENT DOCUMENTS

| | | | | |
|---|---|---|---|---|
| 2003/0159839 | A1 | 8/2003 | Perko | |
| 2005/0074298 | A1 | 4/2005 | Jones | |
| 2008/0063479 | A1 | 3/2008 | Stroyer | |
| 2012/0291394 | A1 * | 11/2012 | Tooman | E02D 27/42 52/699 |
| 2013/0309024 | A1 | 11/2013 | Jones | |
| 2014/0356076 | A1 | 12/2014 | Hale et al. | |

FOREIGN PATENT DOCUMENTS

| | | | | |
|---|---|---|---|---|
| CN | 102787596 | A | 11/2012 | |
| DE | 9409546 | U1 * | 9/1994 | E04H 12/2215 |
| DE | 102005036090 | A1 * | 2/2007 | E02D 5/80 |
| EP | 3258035 | A1 * | 12/2017 | E01F 15/0476 |
| JP | 2002348861 | A | 12/2002 | |
| JP | 2009035937 | A | 2/2009 | |
| KR | 101081556 | B1 | 11/2011 | |
| NZ | 299662 | | 6/1998 | |

* cited by examiner

SUPPORT APPARATUS FOR SUPPORTING A HEADSTONE

TECHNICAL FIELD

The invention relates to support apparatuses, and more specifically to support apparatuses for supporting headstones.

BACKGROUND

Headstones have been used for centuries to mark graves and can take many forms. A typical headstone includes a stone slab having a lower portion which is generally rectangular and an upper portion which can have a semicircular or an arcuate profile.

When the headstone is installed over a corresponding grave, at least part of the lower portion is buried underground in the soil, under a ground surface, and the rest of the lower portion and the top portion extend over the ground surface.

Headstones of this design typically have an inscription or engraving on their front and/or rear face. Alternatively, the headstone could include a statue or another type of representation which is adapted to be viewed properly when the headstone is generally vertical.

For aesthetic and practical reasons, it is therefore desirable that the headstone remain in a generally vertical orientation once installed, preferably permanently.

Unfortunately, there can be movement of the soil over time, which can result in the headstone becoming angled relative to the vertical, and even to the headstone becoming completely unsupported and falling over.

There is therefore a need for an apparatus which would overcome at least one of the above-identified drawbacks.

BRIEF SUMMARY

According to one aspect, there is provided a support apparatus for supporting a headstone, the apparatus comprising: a pile having a top end and a bottom end; a helical member secured to the bottom end of the pile; and a pile head secured to the top end of the pile, the pile head having a mounting portion engaging the top end of the pile and a holding portion extending away from the mounting portion for engaging a bottom end portion of the headstone to maintain the headstone in a vertical orientation.

In one embodiment, the mounting portion of the pile head includes: a sleeve having an open first end for receiving the top end of the pile and a closed second end, the sleeve defining a longitudinal axis; and a lower positioning plate extending orthogonally to the longitudinal axis and secured to the second end of the sleeve.

In one embodiment, the holding portion includes: an upper positioning plate spaced from the lower positioning plate, away from the pile; and a connection assembly connecting the upper positioning plate to the lower positioning plate, the connection assembly being configured to maintain the upper positioning plate at a desired distance from the lower positioning plate.

In one embodiment, the connection assembly includes at least one threaded rod, each threaded rod having an upper end secured to the upper positioning plate and a lower end engaging a corresponding receiving hole defined in the lower positioning plate.

In one embodiment, the at least one threaded rod includes four threaded rods disposed generally orthogonally to the lower and upper positioning plates.

In one embodiment, the upper positioning plate is rectangular, and further wherein the upper end of each threaded rod is secured to a corresponding corner of the upper positioning plate.

In one embodiment, the connection assembly further includes at least one nut threadably engaging the threaded rod for fastening the lower positioning plate to the lower end of the at least one threaded rod.

In one embodiment, the at least one nut includes a pair of nuts spaced apart to receive and hold the lower positioning plate therebetween.

In one embodiment, the connection assembly further includes at least one split washer disposed between the at least one nut and the lower positioning plate to prevent rotation of the at least one nut relative to the lower positioning plate.

In one embodiment, the receiving holes of the lower positioning plate are oblong to allow lateral adjustment of the upper positioning plate relative to the lower positioning plate.

In one embodiment, the top portion includes a peg extending away from the pile, the peg being sized and shaped to be received in a corresponding recess defined in a bottom face of the headstone.

In one embodiment, the peg is tubular and has a circular cross-section.

In one embodiment, the top portion includes a peg having a lower end secured to the upper positioning plate and an upper end disposed away from the upper positioning plate.

In one embodiment, the peg is tubular and defines a longitudinal axis orthogonal to the upper positioning plate.

In one embodiment, the peg is centered on the upper positioning plate.

In one embodiment, the top portion includes a clamp assembly sized and shaped for snuggly receiving and holding the bottom portion of the headstone.

In one embodiment, the clamp assembly includes a first jaw member connected to the upper positioning plate and a second jaw member movably connected to the first jaw member.

In one embodiment, the first jaw member includes a rectangular panel extending perpendicular to the upper positioning plate.

In one embodiment, the rectangular panel includes a central rectangular opening.

In one embodiment, the second jaw member includes an upper second jaw portion and a lower second jaw portion spaced from the upper second jaw portion.

In one embodiment, each second jaw portion includes an elongated band extending parallel to the first jaw member.

In one embodiment, the first jaw member includes a first side portion and a second side portion, and wherein each second jaw portion includes a first connecting portion connected to the first side portion of the first jaw member, a second connecting portion connected to the second side portion of the first jaw member and a central clamping portion extending between the first and second connecting portions.

In one embodiment, the central clamping portion is spaced from the first jaw member to define a receiving recess therebetween, the receiving recess being sized and shaped to receive the bottom end of the headstone.

Figure 1:
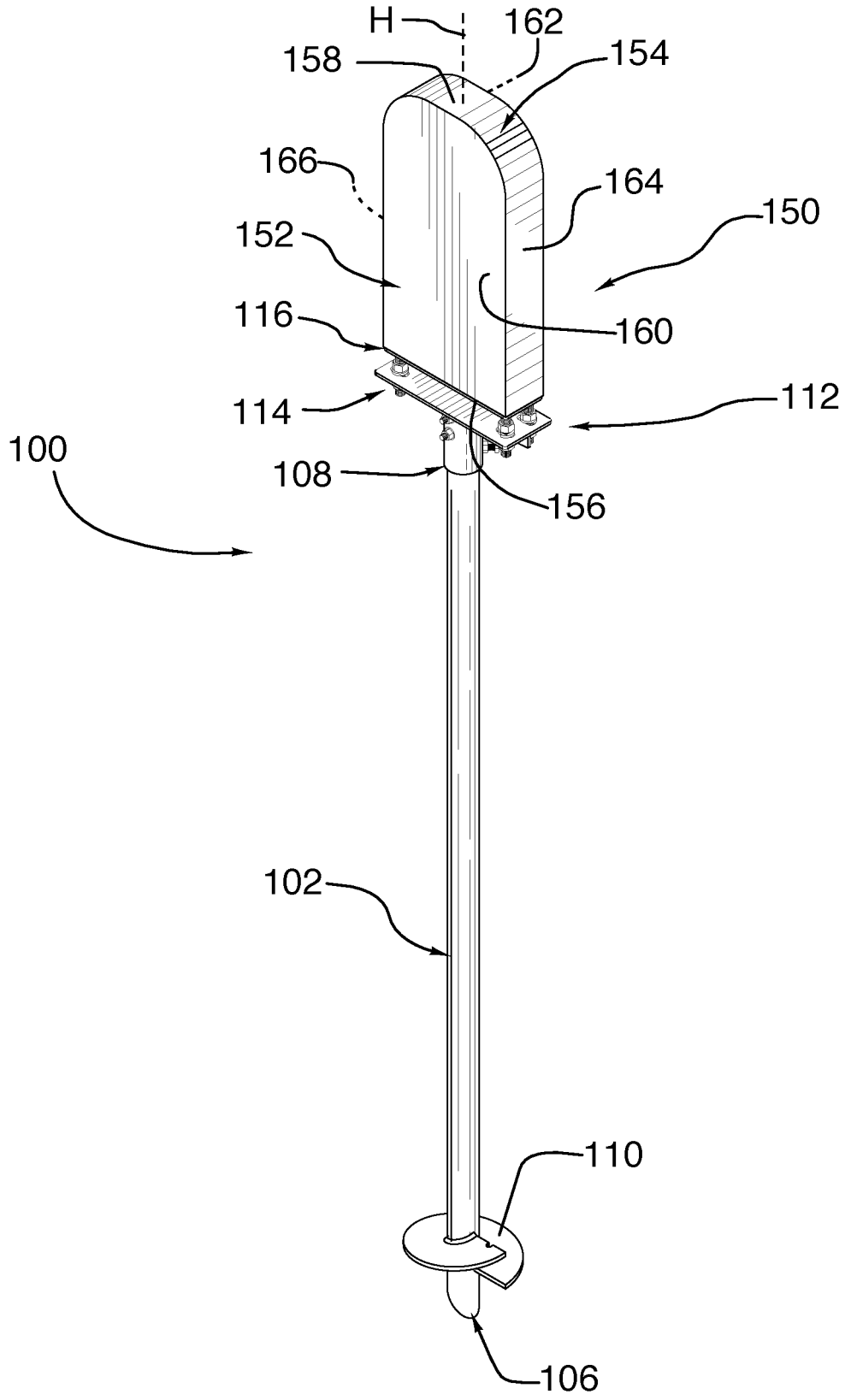
FIG. 1 is a top front perspective view of a support apparatus for supporting a headstone, in accordance with one embodiment, showing a headstone being supported by the support apparatus.
Figure 2:
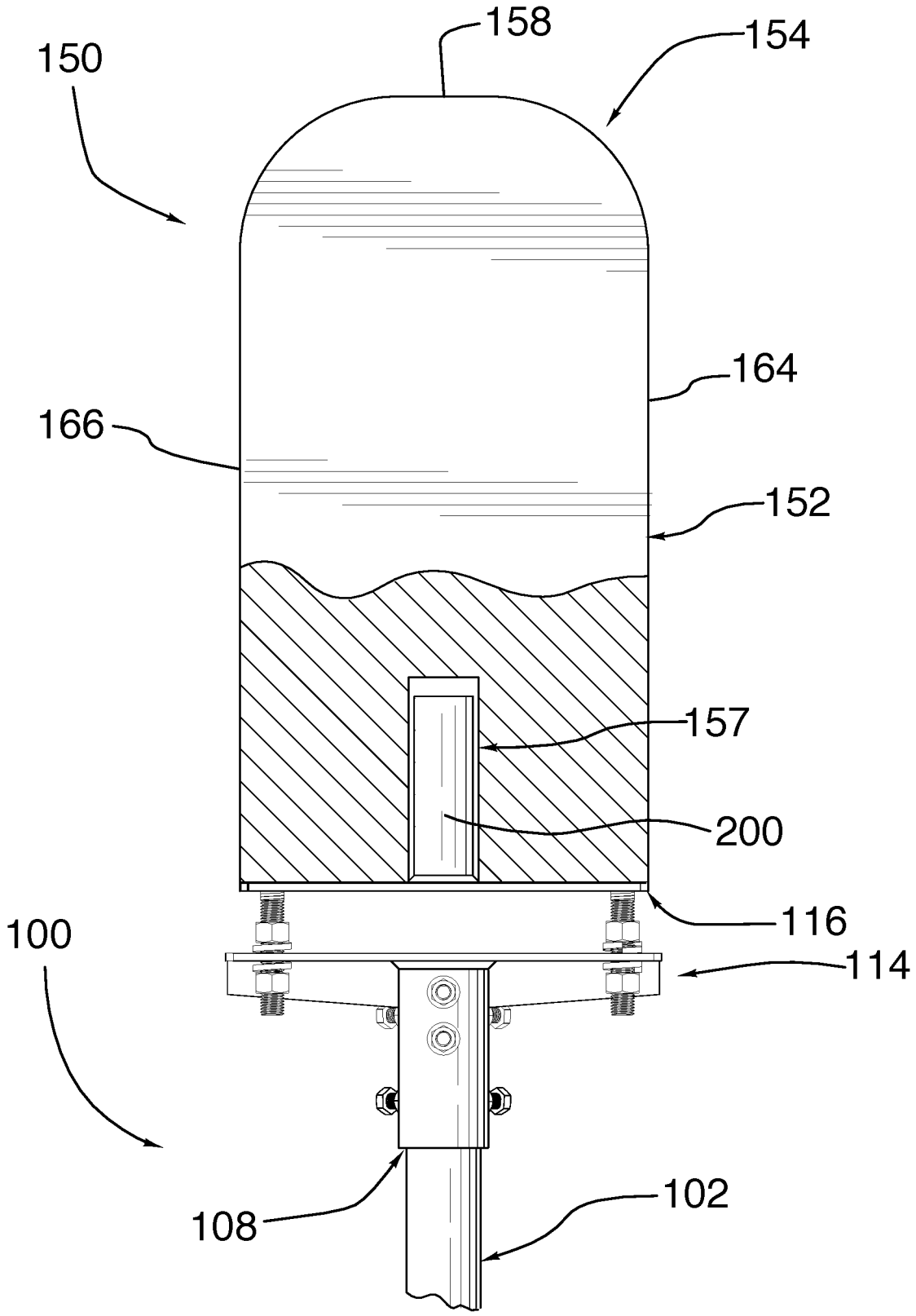
FIG. 2 is a partial, enlarged front elevation view of the support apparatus of FIG. 1, with the headstone partially cross-sectioned.
Figure 3:
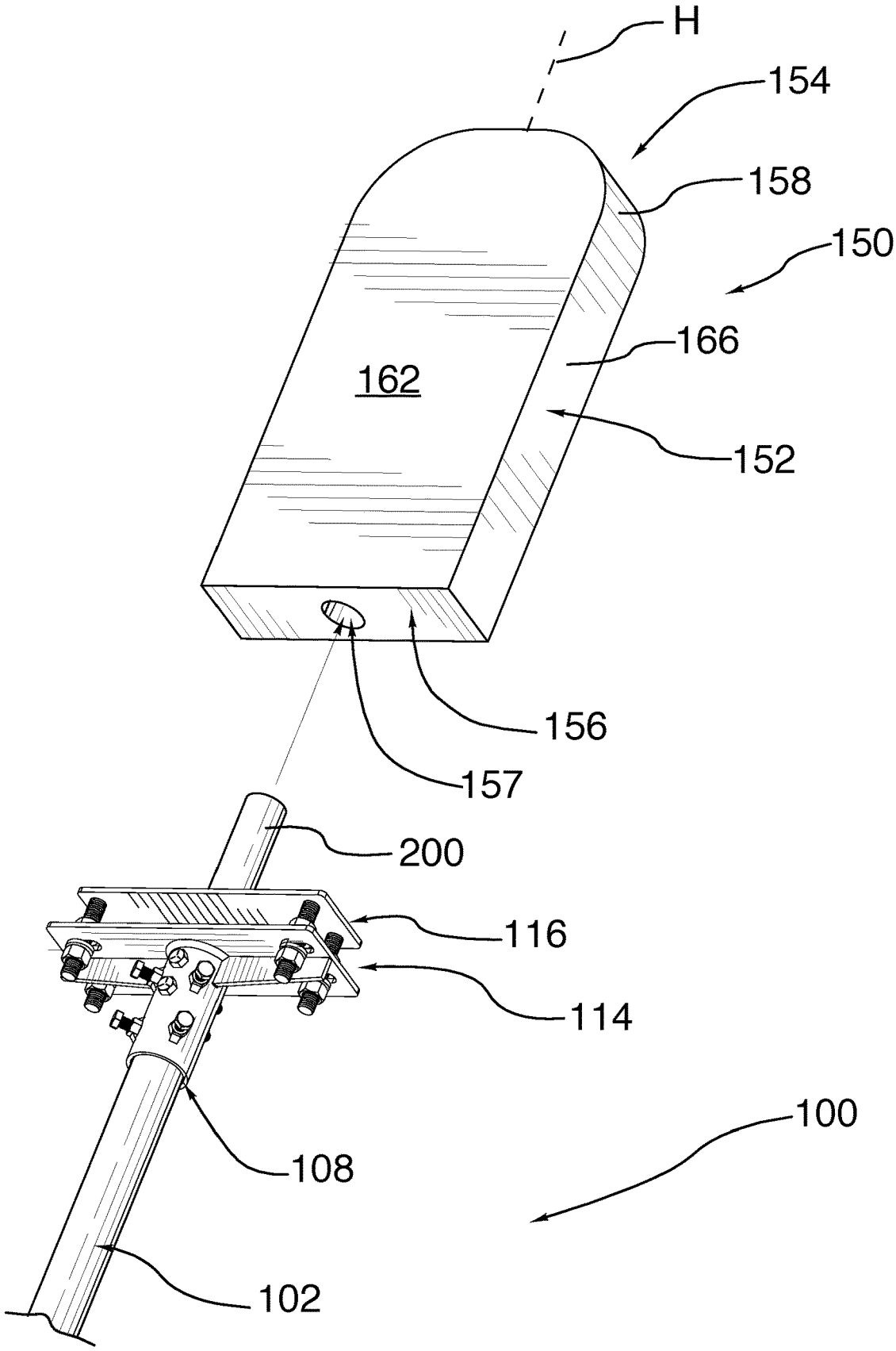
FIG. 3 is a partial bottom, rear perspective view of the support apparatus of FIG. 1, with the headstone removed.
Figure 4:
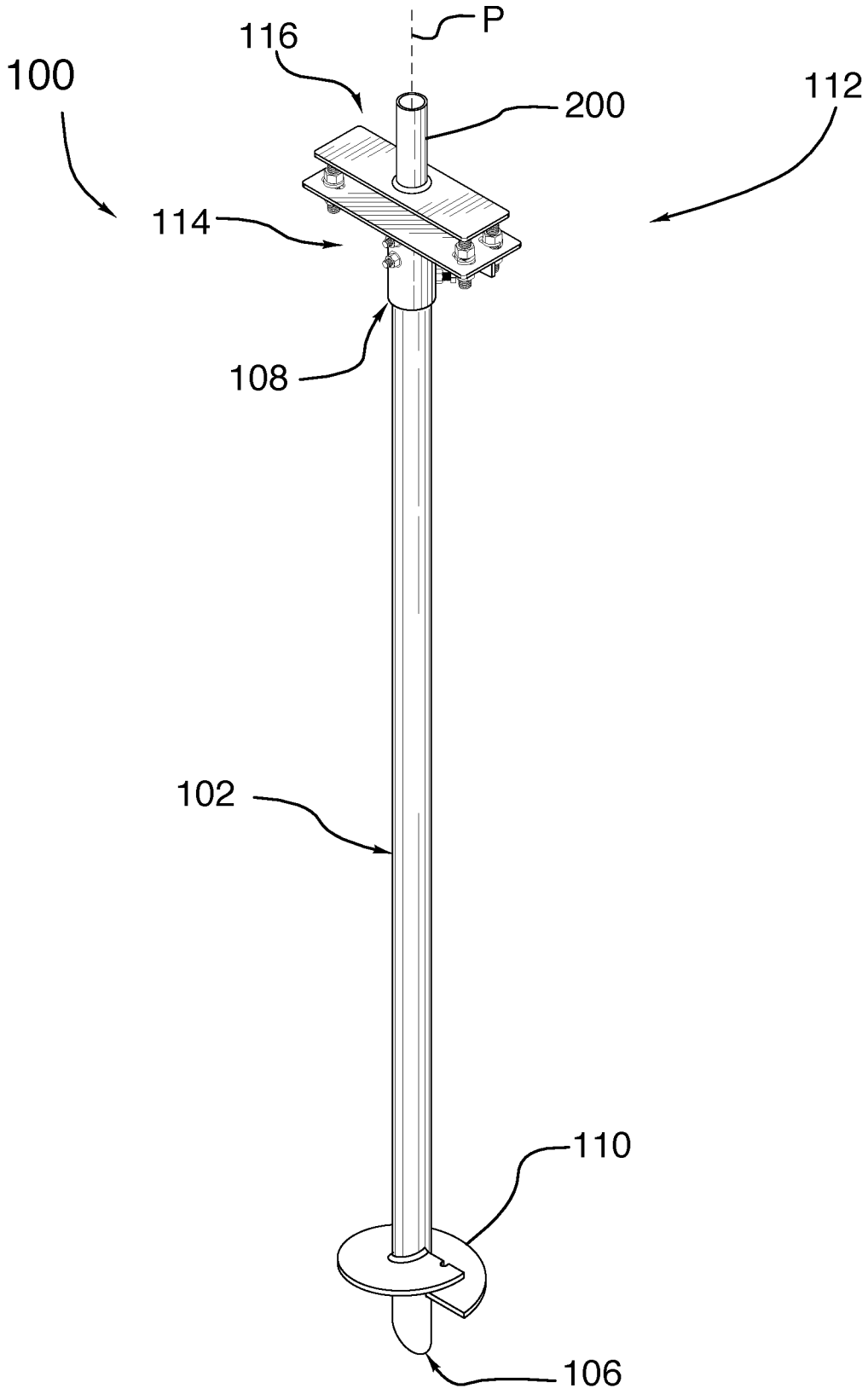
FIG. 4 is another top front perspective view of the support apparatus of FIG. 1, with the headstone removed.

Further details of the invention and its advantages will be apparent from the detailed description included below.

DETAILED DESCRIPTION

In the following description of the embodiments, references to the accompanying drawings are by way of illustration of an example by which the invention may be practiced. It will be understood that other embodiments may be made without departing from the scope of the invention disclosed.

Referring first to FIGS. 1 to 4, there is provided a support apparatus 100 for supporting a headstone 150, in accordance with one embodiment.

In the illustrated embodiment, the headstone 150 includes a typical headstone made of a slab of stone or similar material defining a generally rectangular bottom portion 152 and a convex top portion 154 extending away from the bottom portion 152. Specifically, the headstone 150 has a planar bottom face 156, a top arcuate face 158, planar front and rear faces 160, 162 orthogonal to the bottom face 156 and a pair of planar side faces 164, 166 orthogonal to both the bottom face 156 and the front and rear faces 160, 162. Still in the illustrated embodiment, the headstone 150 is generally elongated and therefore defines a headstone axis H which is parallel to the front, rear and side faces 160, 162, 164, 166 of the headstone 150.

In the embodiment illustrated in FIGS. 1 to 4, the headstone 150 further includes a recess, 157, extending into the bottom portion 152 from the bottom face 156 into the headstone 150 towards the top portion 154. Specifically, the recess 157 is generally cylindrical and elongated, and is generally centered on the bottom face 156 of the headstone 150. The recess 157 further defines a recess axis and the recess axis is generally coaxial with the headstone axis H. Alternatively, the recess 157 could be off-centered relative to the bottom face 156.

Still referring to FIGS. 1 to 4, the apparatus 100 includes a pile 102 having a bottom end 106 and a top end 108 located away from the bottom end 106. The pile 102 is generally elongated and is adapted to be buried in the soil, below a ground surface in a generally vertical orientation, with the bottom end 106 disposed below the top end 108.

In the embodiment illustrated in FIGS. 1 to 4, the pile 102 is generally hollow and has a circular cross-section. Alternatively, the pile 102 could have a square cross-section or any other shape which a skilled addressee would consider appropriate.

Still in the illustrated embodiment, the apparatus 100 further includes a helical member 110 secured to the bottom end 106 of the pile 102. The helical member 110 is adapted to engage the soil and enable the pile to move downwardly or be screwed into the soil when the pile 102 is rotated. Specifically, the top end 108 of the pile 102 may be connected to a corresponding machine or tool adapted to rotate the pile 102 so as to screw the pile 102 deeper into the soil. The bottom end 106 of the pile 102 can therefore be buried at a desired distance under the ground surface by a user standing on the ground surface and having only access to the top end 108 of the pile 102.

The apparatus 100 further includes a pile head 112 secured to the top end 108 of the pile 102. Specifically, the pile head 112 includes a mounting portion 114 which engages the top end 108 of the pile 102, and a holding portion 116 which extends away from the mounting portion 114.

The holding portion 116 is adapted to engage the bottom portion 152 of the headstone 150 to prevent movement of the headstone 150 relative to the pile 102 in order for the headstone axis H to remain parallel to the pile 102, as it will become apparent below.

In the embodiment illustrated in FIGS. 1 to 4, the holding portion 116 of the pile head 112 includes a peg 200 which extends away from the mounting portion 114. The peg 200 is sized and shaped to be received in the recess 157 defined in the bottom portion 152 of the headstone 150. The peg 200 is generally tubular and defines a longitudinal axis P which is generally parallel to the pile 102. When the peg 200 is received in the recess 157 of the headstone 150, the headstone axis H is therefore generally parallel to the longitudinal axis of the peg 102.

It will be appreciated that when the headstone 150 is installed at its desired location such that the peg 200 is received in the recess 157 of the headstone 150, the pile 102 acts as an anchor to maintain the headstone 150 in a vertical orientation. More specifically, since the bottom end 106 of the pile 102 is located relatively deep below the ground surface, the orientation of the pile 102 will remain relatively unaffected by movement of the soil near the ground surface and will therefore maintain the headstone is a generally vertical orientation. The pile 102 will also prevent the headstone 150 from moving away from a vertical orientation if the headstone 150 is bumped or otherwise pushed laterally.

While in the illustrated embodiment, the holding portion 116 of the pile head 112 includes only one peg 200 which extends away from the mounting portion 114, sized and shaped to be received in only one recess 157 defined in the bottom portion 152 of the headstone 150, it will be appreciated that the holding portion 116 could be provided with two or more pegs similar to peg 200, and that the headstone 150 could be provided with a corresponding number of recesses similar to recess 157. Furthermore, it will be appreciated that in such a case, the pegs and corresponding recesses could all be sized and shaped differently. For instance, the holding portion 116 could be provided with two pegs, one having a circular cross-section (e.g. similar to peg 200) and the other one having a generally square cross-section, where the pegs would be received in recesses having corresponding shape and size.

It will also be appreciated that an adhesive could be used to help securing the headstone 150 to the holding portion 116 of the pile 102. For instance, an epoxy adhesive or any other type of suitable adhesive could be applied into the recess 157 of the headstone 150, the adhesive contributing to secure the headstone 150 to the holding portion 116 when the peg 200 is engaged in the recess 157.

Referring now to FIGS. 5 to 8, the mounting portion 114 of the pile head 112 includes a sleeve 300 and a lower positioning plate 302 secured to the sleeve 300. The sleeve 300 is adapted to receive the top end 108 of the pile 102, and is therefore sized and shaped to match the size and shape of the top end 108 of the pile 102. In the illustrated embodiment, the sleeve 300 therefore has a circular cross-section to receive the cylindrical top end 108 of the pile 102.

The sleeve 300 has a lower end 304 which is open to allow the top end 108 of the pile 102 to be inserted into the sleeve 300 and an upper end 306 to which the lower positioning plate 302 is secured, effectively closing off the upper end 306. More specifically, the sleeve 300 defines a longitudinal axis and the lower positioning plate 302 is disposed orthogonally to the longitudinal axis of the sleeve 300. The sleeve 300 is further generally centered on the lower positioning plate 302 and is secured to the top end 108 of the pile 102 using one or more fasteners 307 which could include one or more through bolts 307*a* with corresponding nuts 307*b* extending through corresponding aligned holes in the sleeve 300 and the top end 108 of the pile 102. In one embodiment, the one or more fasteners 307 could also include one or more bolts 307*c* threadably engaging corresponding nuts 307*d* welded to the top end 108 of the pile and aligned with corresponding openings in the sleeve 300 and the top end 108 of the pile 102.

Figure 7:
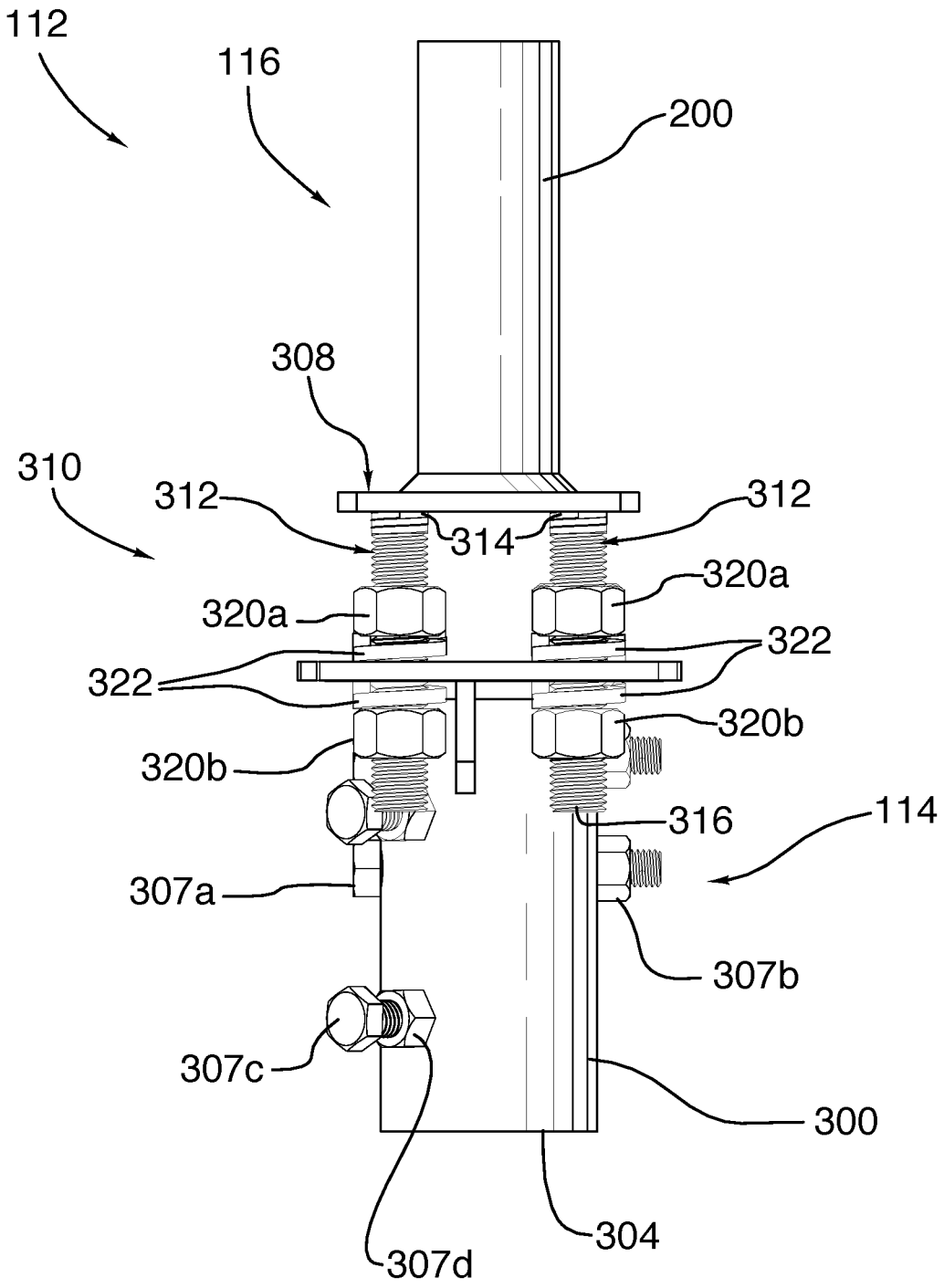
FIG. 7 is a right side elevation view of the pile head illustrated in FIG. 5.

Still referring to FIGS. 5 to 8, the holding portion 116 of the pile head 112 includes an upper positioning plate 308 and a connection assembly 310 which connects the upper positioning plate 308 to the lower positioning plate 302. As best shown in FIG. 7, the upper positioning plate 308 is spaced away from the lower positioning plate 302 and away from the pile 102, and the lower and upper positioning plates 302, 308 are disposed in planes which are generally parallel to each other.

Figure 8:
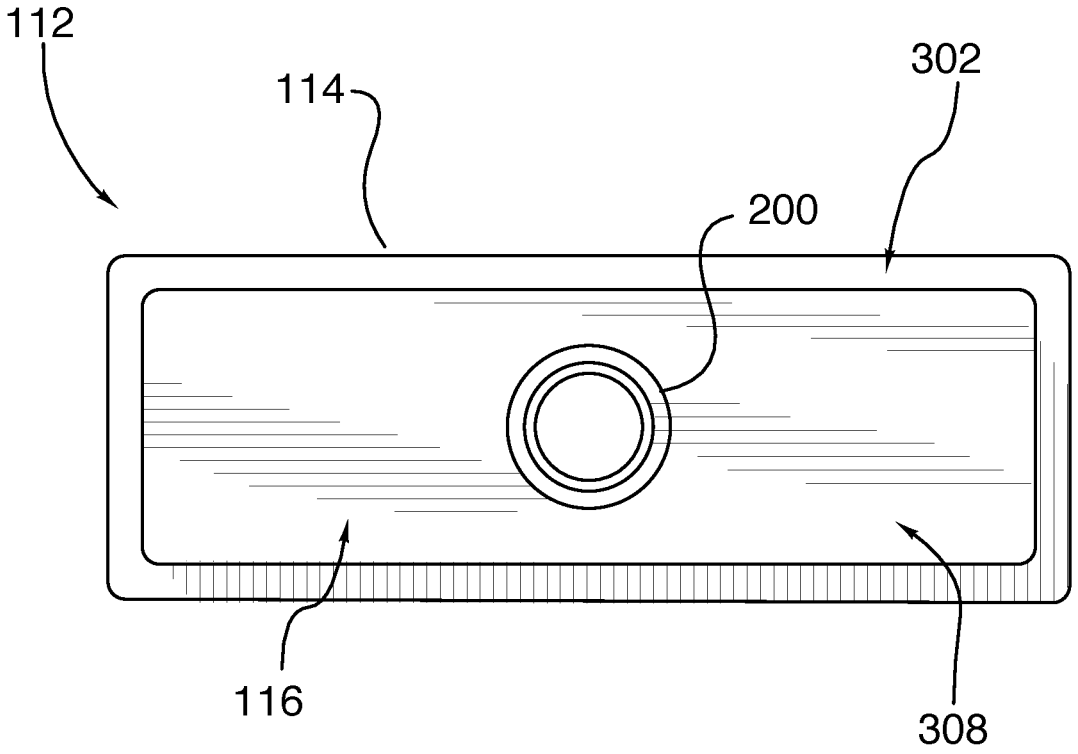
FIG. 8 is a top plan view of the pile head illustrated in FIG. 5.
Figure 9:
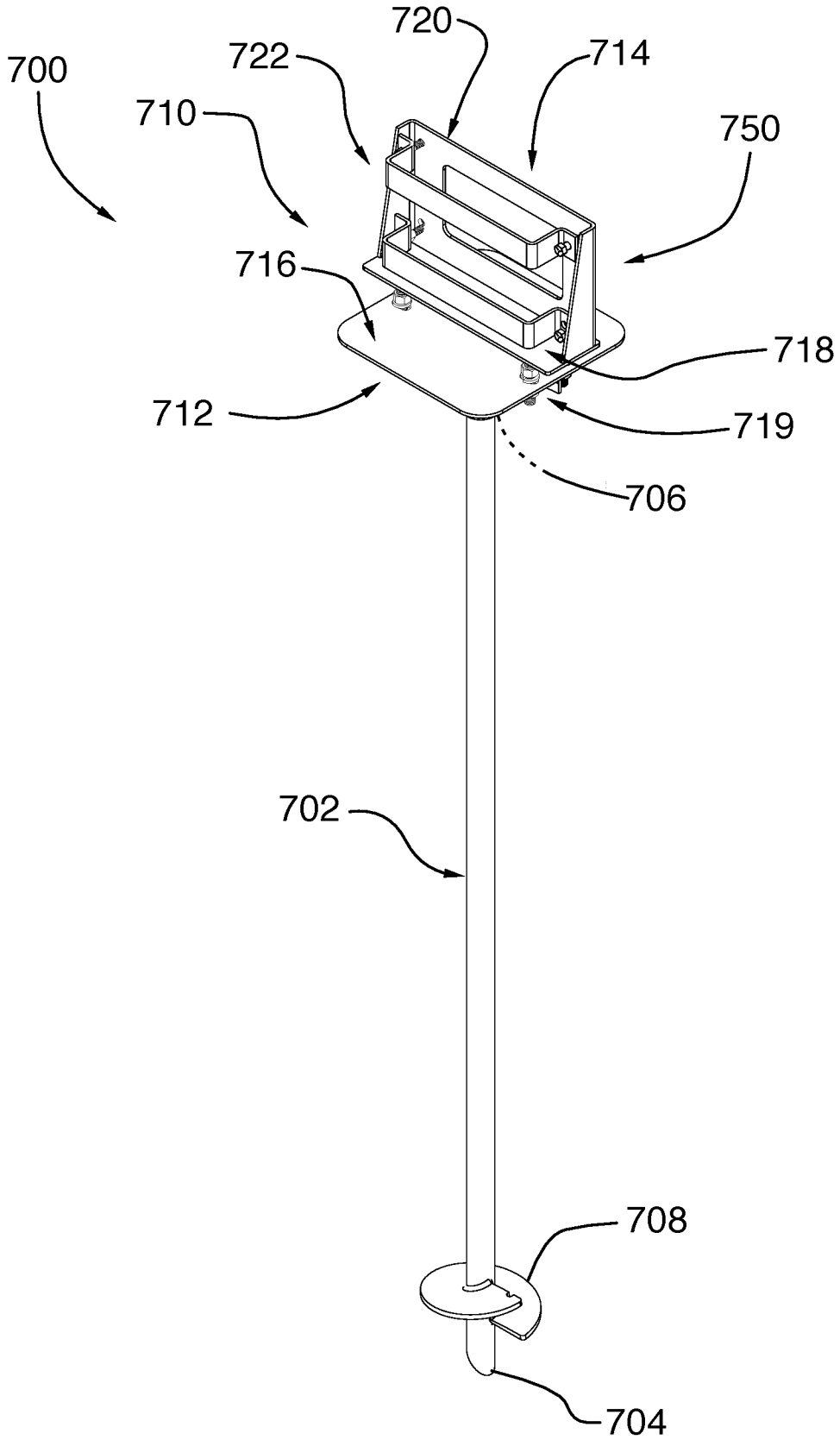
FIG. 9 is a top perspective view of a support apparatus for supporting a headstone, in accordance with an alternative embodiment.
Figure 10:
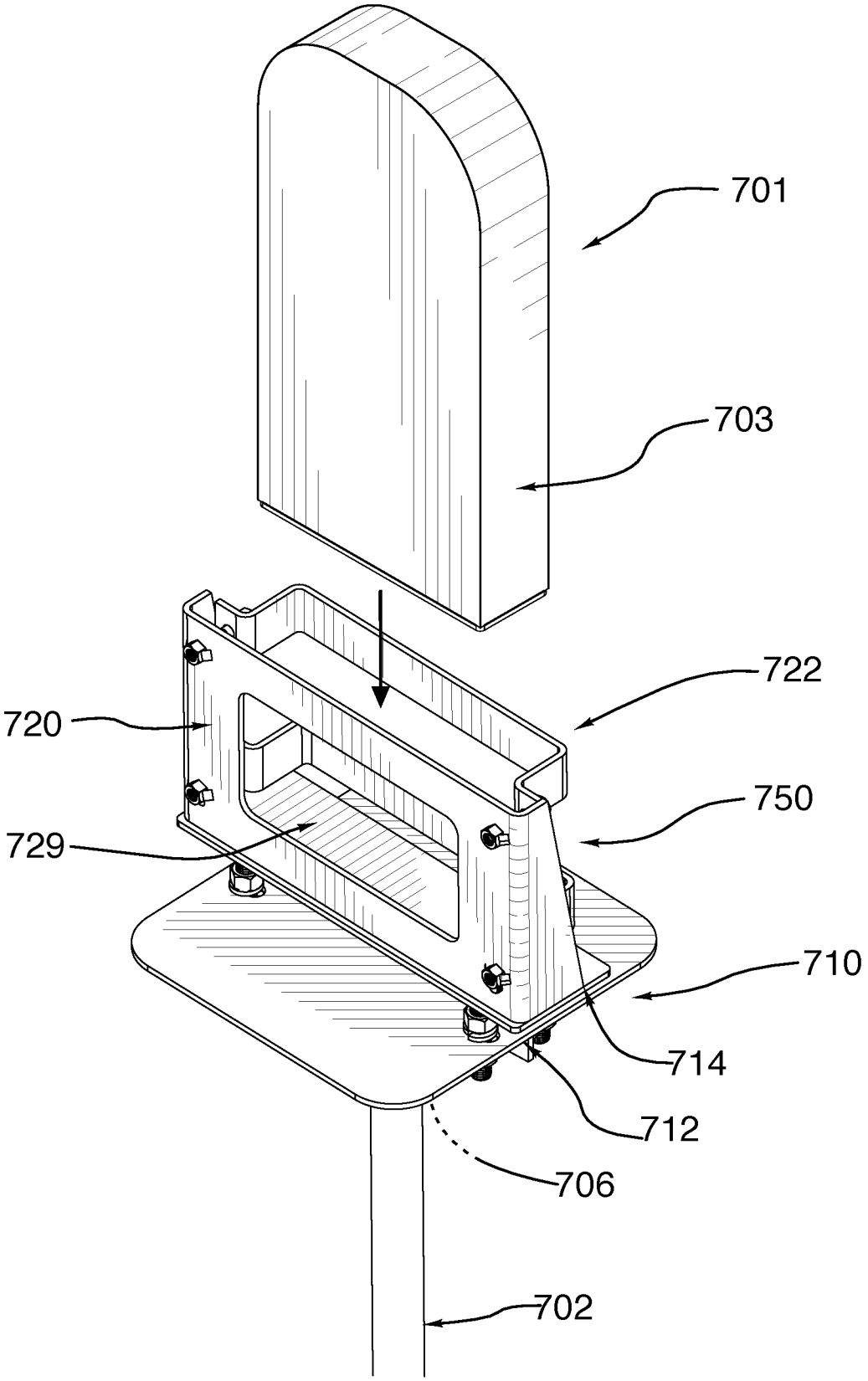
FIG. 10 is a partial top, rear perspective view of the support apparatus of FIG. 9, with the headstone removed.

In the embodiment illustrated in FIGS. 5 to 8, the lower and upper positioning plates 302, 308 are both generally rectangular and elongated such that each positioning plate 302, 308 define a longitudinal axis. As best shown in FIG. 8, the lower and upper positioning plates 302, 308 are disposed such that their longitudinal axes are generally parallel to each other.

As further shown in FIG. 8, the upper positioning plate 308 has a slightly smaller area than the lower positioning plate 302 and is generally centered over the lower positioning plate 302. Alternatively, the lower and upper positioning plates 302, 308 could have a similar area, or even have entirely different sizes and shapes.

As further shown in FIG. 8, the peg 200 is generally centered on the upper positioning plate 308 and is secured to the upper positioning plate 308 by welding or any other securing techniques which a skilled addressee would consider appropriate. In one embodiment, the upper positioning plate 308 also has generally the same size and shape as the bottom face 156 of the headstone 150 to allow the headstone 150 to sit flush on the upper positioning plate 308 when the peg 200 is received in the recess 157 of the headstone 150. This configuration allows the upper positioning plate 308 to vertically support the headstone 150 and further prevents movement of the headstone 150 relative to the apparatus 100.

Still referring to FIGS. 5 to 8, the connection assembly 310 is configured to maintain the upper positioning plate 308 at a desired distance from the lower positioning plate 302. In the embodiment illustrated in FIGS. 5 to 8, the connection assembly 310 includes four threaded rods 312 disposed generally orthogonally to the upper and lower positioning plates 302, 308. More specifically, each threaded rod 312 has an upper end 314 secured to the upper positioning plate 308 and a lower end 316 which engages a corresponding receiving hole 318 defined in the lower positioning plate 302.

Figure 5:
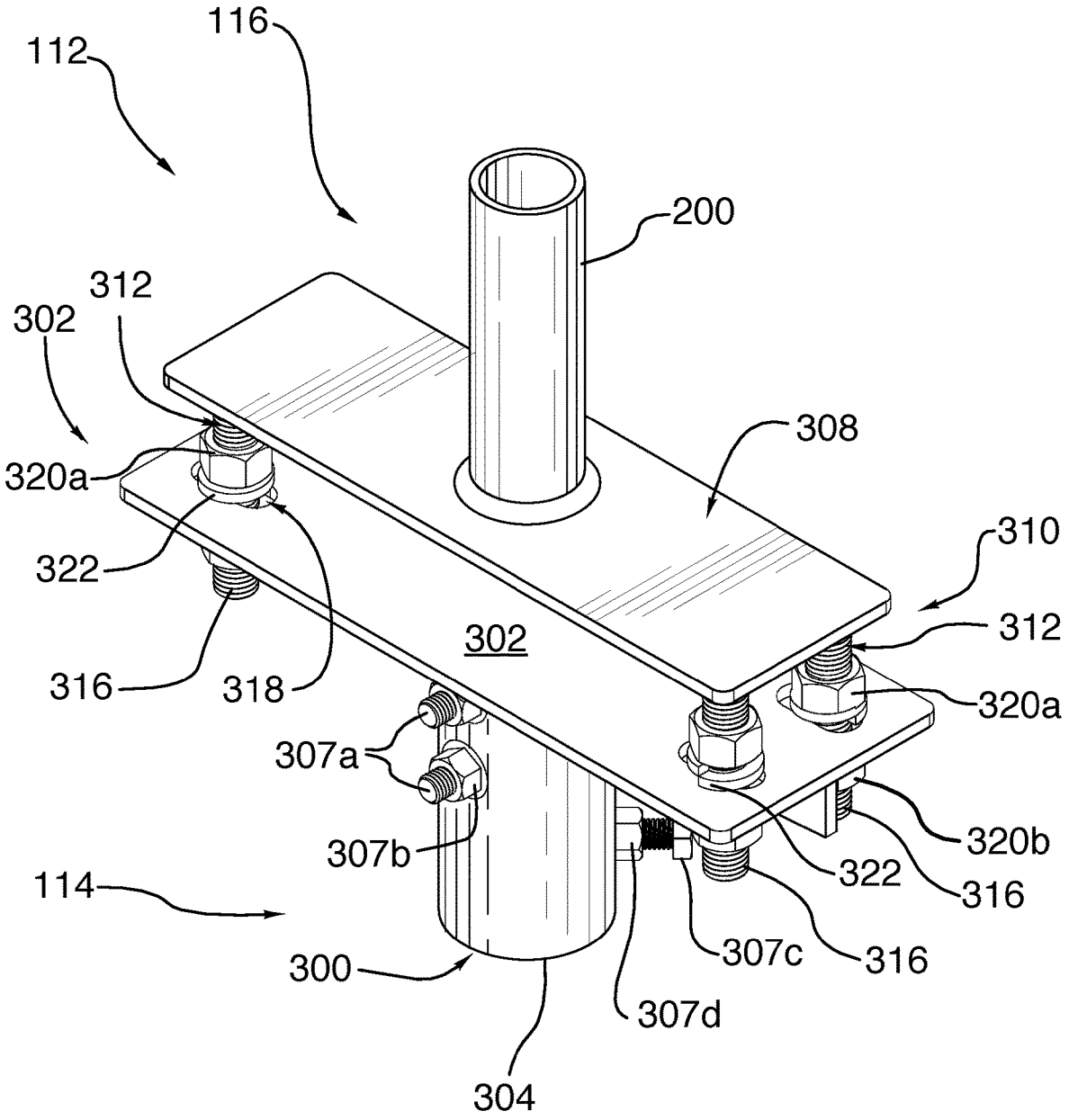
FIG. 5 is a top perspective view of a pile head for the support apparatus illustrated in FIG. 1.
Figure 6:
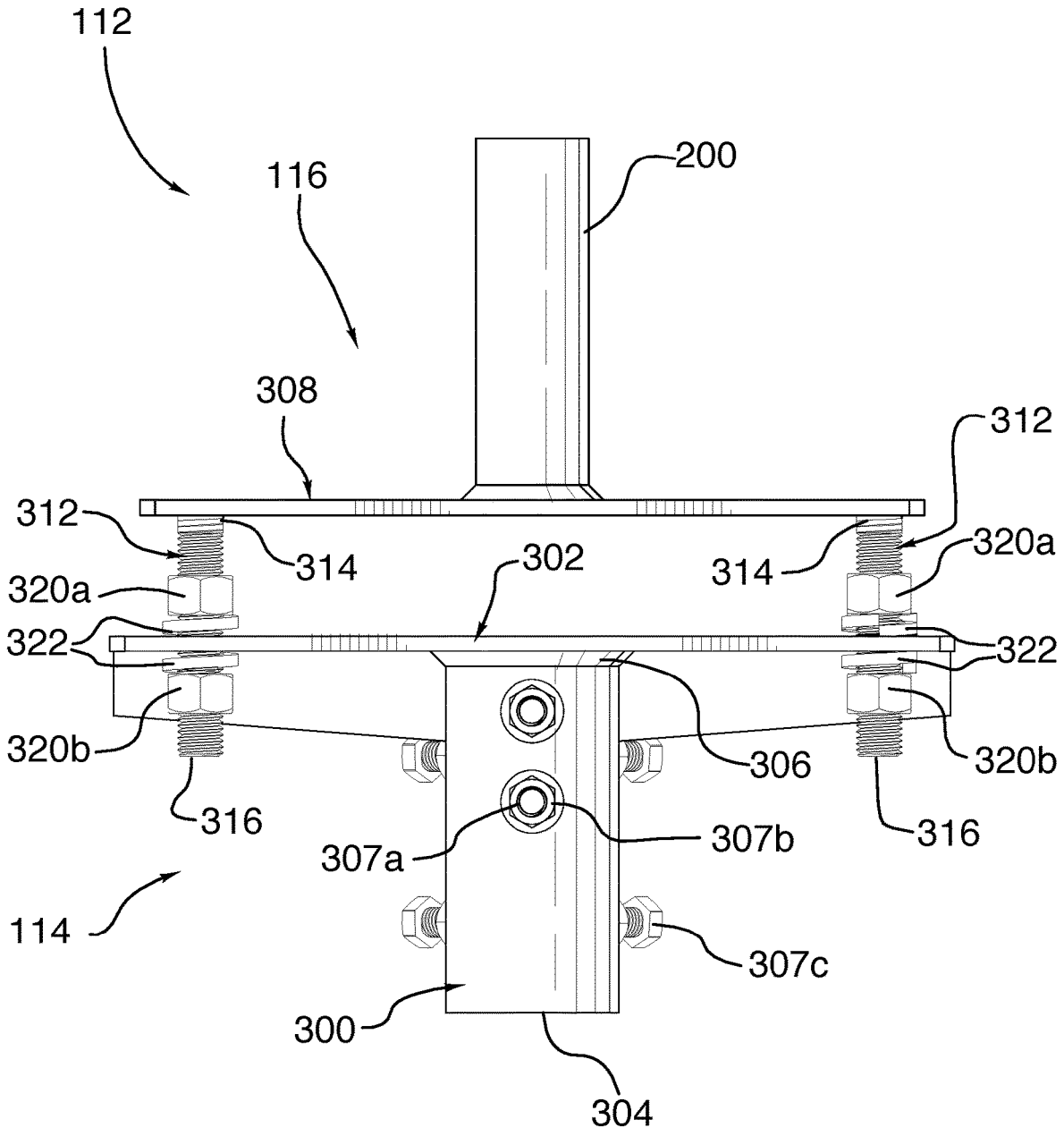
FIG. 6 is a front elevation view of the pile head illustrated in FIG. 5.

In the illustrated embodiment, each threaded rod 312 is disposed generally in one of the four corners of the upper positioning plate 308 and the lower positioning plate 302 includes four receiving holes 318 located at the four corners of the lower positioning plate 302. As best shown in FIG. 5, each receiving hole 318 is generally oblong. Specifically, each receiving hole 318 is elongated along a longitudinal axis which is generally parallel to the longitudinal axis of the lower positioning plate 302. This allows the position of the upper positioning plate 308 to be adjusted laterally in a longitudinal direction relative to the lower positioning plate 302.

It will also be appreciated that this configuration further allows the orientation of the upper positioning plate 308 to be adjusted relative to the lower positioning plate 302. More specifically, the oblong receiving holes 318 allow the threaded rods 312 to extend through the lower positioning plate 302 while being angled relative to the lower positioning plate 302, rather than being orthogonal to the lower positioning plate 302. For example, if the pile 102, when buried in the soil, is slightly angled relative to the vertical instead of being exactly vertical, the orientation of the upper positioning plate 308 could be adjusted such that the upper positioning plate 308 is still disposed along a horizontal plane such that the headstone axis H is vertical. Alternatively, the receiving holes 318 could instead be circular instead of being oblong, or they could have any other suitable shape.

Still in the embodiment illustrated in FIGS. 5 to 8, the connection assembly 310 further includes a plurality of nuts 320 which threadably engage the threaded rods 312 and abut the lower positioning plate 302 to prevent movement of the upper positioning plate 308 relative to the lower positioning plate 302 once the upper positioning plate 308 has been set to a desired position and/or orientation relative to the lower positioning plate 302.

Specifically, the plurality of nuts 320 include four pair of nuts 320*a*, 320*b*, each pair of nuts 320*a*, 320*b* engaging one of the four threaded rods 312. Specifically, when the holding portion 116 of the pile head 112 is connected to the mounting portion 114, the lower end 316 of each thread rod 312 extends below the lower positioning plate 302. Each pair of nuts 320*a*, 320*b* includes an upper nut 320*a* located on the corresponding threaded rod 312 between the lower positioning plate 302 and the upper positioning plate 308 and a lower nut 320*b* engaging the lower end 316 of the threaded rod 312 below the lower positioning plate 302. The upper and lower nuts 320*a*, 320*b* can be threadably moved towards each other to "sandwich" and hold the lower positioning plate 302 between the upper and lower nuts 320*a*, 320*b* and thereby prevent further movement of the upper positioning plate 308 relative to the lower positioning plate 302. It will be appreciated that by moving the upper and lower nuts 320*a*, 320*b* along the threaded rods 312, the distance between the lower and upper positioning plates 302, 308 can be adjusted as desired.

In the embodiment illustrated in FIGS. 5 to 8, the connection assembly 310 further includes a plurality of split washers 322 disposed between the upper and lower nuts 320*a*, 320*b* and the lower positioning plate 302. It will be appreciated that the split washers 322 create friction between the upper and lower nuts 320*a*, 320*b* and the lower positioning plate 302 to prevent unwanted rotation of the nuts 320*a*, 320*b*, which could result in the upper positioning plate 308 moving into an undesired position and/or orientation relative to the lower positioning plate 302. Alternatively, the connection assembly 310 may not include any split washers 322.

Now turning to FIGS. 9 to 14, there is provided a support apparatus 700 for supporting a headstone 701, in accordance with an alternative embodiment.

The support apparatus 700 is generally similar to the support apparatus 100 illustrated in FIGS. 1 to 8 and described above, except that the support apparatus 700 includes a clamping assembly 750 for holding the headstone 702 in a vertical orientation, instead of a peg 200.

Specifically, the support apparatus 700 includes a pile 702 having a bottom end 704 and a top end 706, a helical member 708 secured to the bottom end 704 of the pile 702 and a pile head 710 secured to the top end 706 of the pile 102, similarly to the support apparatus 100 illustrated in FIGS. 1 to 8.

The pile 702 and the helical member 708 are substantially similar to the pile 102 and the helical member 110 illustrated in FIGS. 1 to 8 and described above, and will therefore not be described further.

Similarly to the pile head 112 illustrated in FIGS. 1 to 8, the pile head 710 includes a mounting portion 712 which engages the top end 706 of the pile 702 and a holding portion 714 which extends away from the mounting portion 712 and which is configured to engage a bottom portion 703 of the headstone 701.

The mounting portion 712 of the pile head 710 is also generally similar to the mounting portion 114 of the pile head 112 illustrated in FIGS. 1 to 8 and described above, except that the mounting portion 712 includes a lower positioning plate 716 which is generally square and has a larger area than the lower positioning plate 302 of the pile head 102 illustrated in FIGS. 1 to 8. Similarly to the lower positioning plate 302 illustrated in FIGS. 1 to 8, the lower positioning plate 716 could alternatively be of any other shape and size.

In the embodiment illustrated in FIGS. 9 to 14, the holding portion 714 includes an upper positioning plate 718 and a connection assembly 719 which are substantially similar to the upper positioning plate 308 and the connection assembly 310 illustrated in FIGS. 1 to 8 and described above.

Still referring to FIGS. 9 to 14, the clamp assembly 750 is connected to the upper positioning plate 718. The clamp assembly 750 is sized and shaped for snuggly receiving and holding the bottom portion of the headstone. Specifically, the clamp assembly 750 includes a first jaw member 720 connected to the upper positioning plate 718 and a second jaw member 722 movably connected to the first jaw member 720.

In the embodiment illustrated in FIGS. 9 to 14, the first jaw member 720 includes a generally rectangular central panel 724 and left and right side panels 726, 728 which are generally perpendicular to the rectangular panel 724. The central panel 724 and the side panels 726, 728 extend generally upwardly from the upper positioning plate 718 and are disposed generally orthogonally to the upper positioning plate 718.

Still in the embodiment illustrated in FIGS. 9 to 14, the side panels 726, 728 are generally trapezoidal. More specifically, each side panel 726, 728 includes a lower edge 725 secured to the upper positioning plate 718 and an upper edge 727 which is substantially longer than the lower edge 725.

The central panel 724 further has a generally rectangular opening 729 which defines a left side portion 730 of the central panel 724 between the opening 729 and the left side panel 726 and a right side portion 732 of the central panel 724 between the opening 729 and the right side panel 728.

Still in the embodiment illustrated in FIGS. 9 to 14, the side panels 726, 728 and the central panel 724 are further integrally formed together. For example, the side panels 726, 728 and the central panel 724 could be made from a single piece of sheet metal which has been bent in a C-shape profile. Alternatively, the side panels 726, 728 and the central panel 724 could include distinct pieces which are secured together by welding or the like.

Still referring to FIGS. 9 to 14, the second jaw member 722 includes an upper second jaw portion 800 and a lower second jaw portion 802 spaced from the upper second jaw portion 800. Specifically, each jaw portion 800, 802 includes an elongated strap member 804 disposed generally horizontally. The strap member 804 includes a planar central clamping portion 806 disposed generally parallel to the central panel 724 of the first jaw member 720 and left and right side S-shaped connecting portions 808, 810 connected respectively to the left and right side portions 730, 732 of the central panel 724. Each connecting portion 808, 810 includes an end tab 812 disposed parallel to the central clamping portion 806 and extending longitudinally away from the central clamping portion 806, and an intermediate panel portion 814 extending between the central clamping portion 806 and the end tab 812 and disposed perpendicularly to the central clamping portion 806.

In the embodiment illustrated in FIGS. 9 to 14, the entire strap member 804 is made of a single piece of material which is bent to define the desired shape. Alternatively, the central clamping portion 806, the end tab 812 and the intermediate panel portion 814 could be provide as separate pieces and further secured together by welding or the like.

Figure 11:
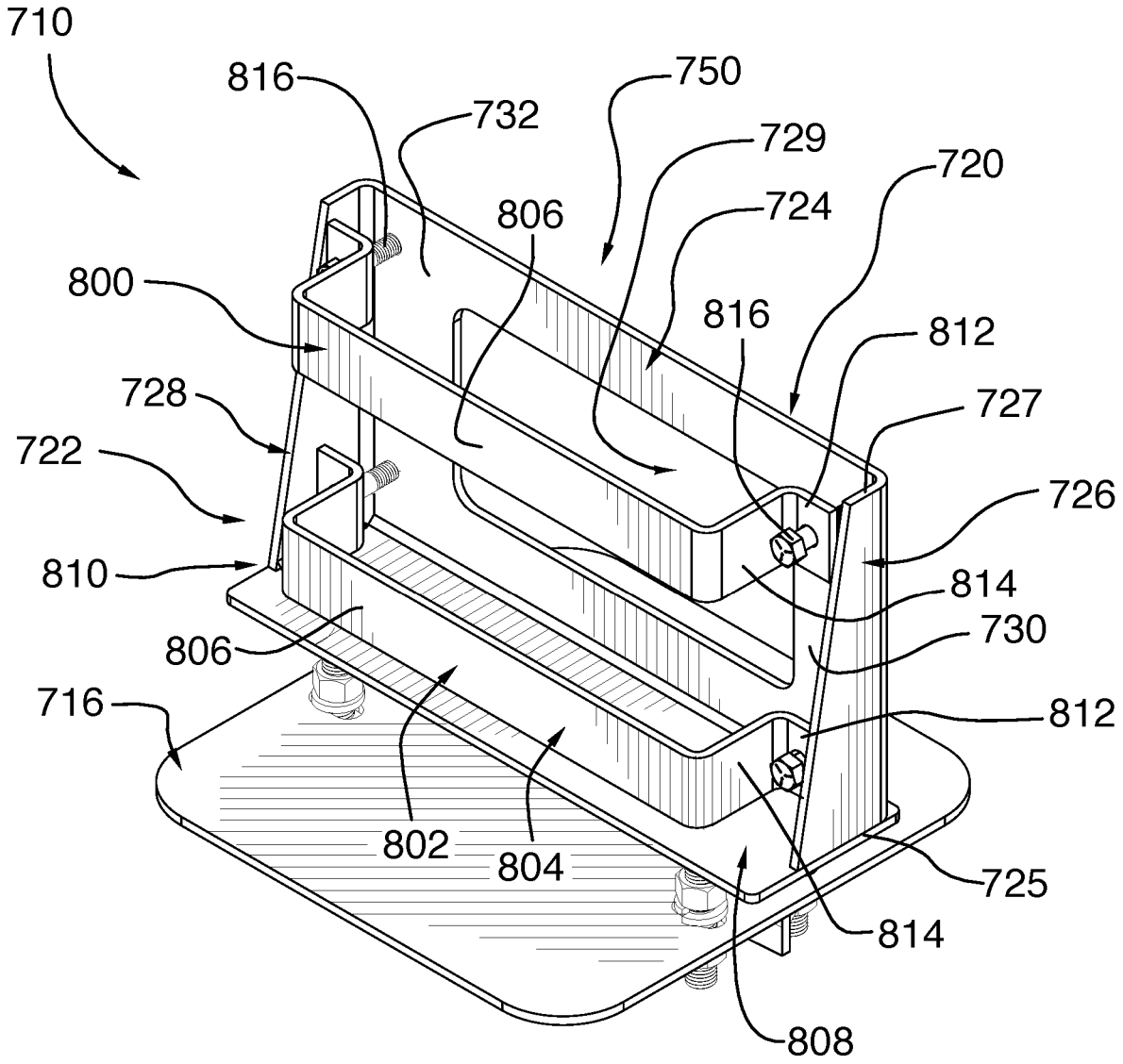
FIG. 11 is a top front perspective view of a pile head for the support apparatus illustrated in FIG. 9.
Figure 12:
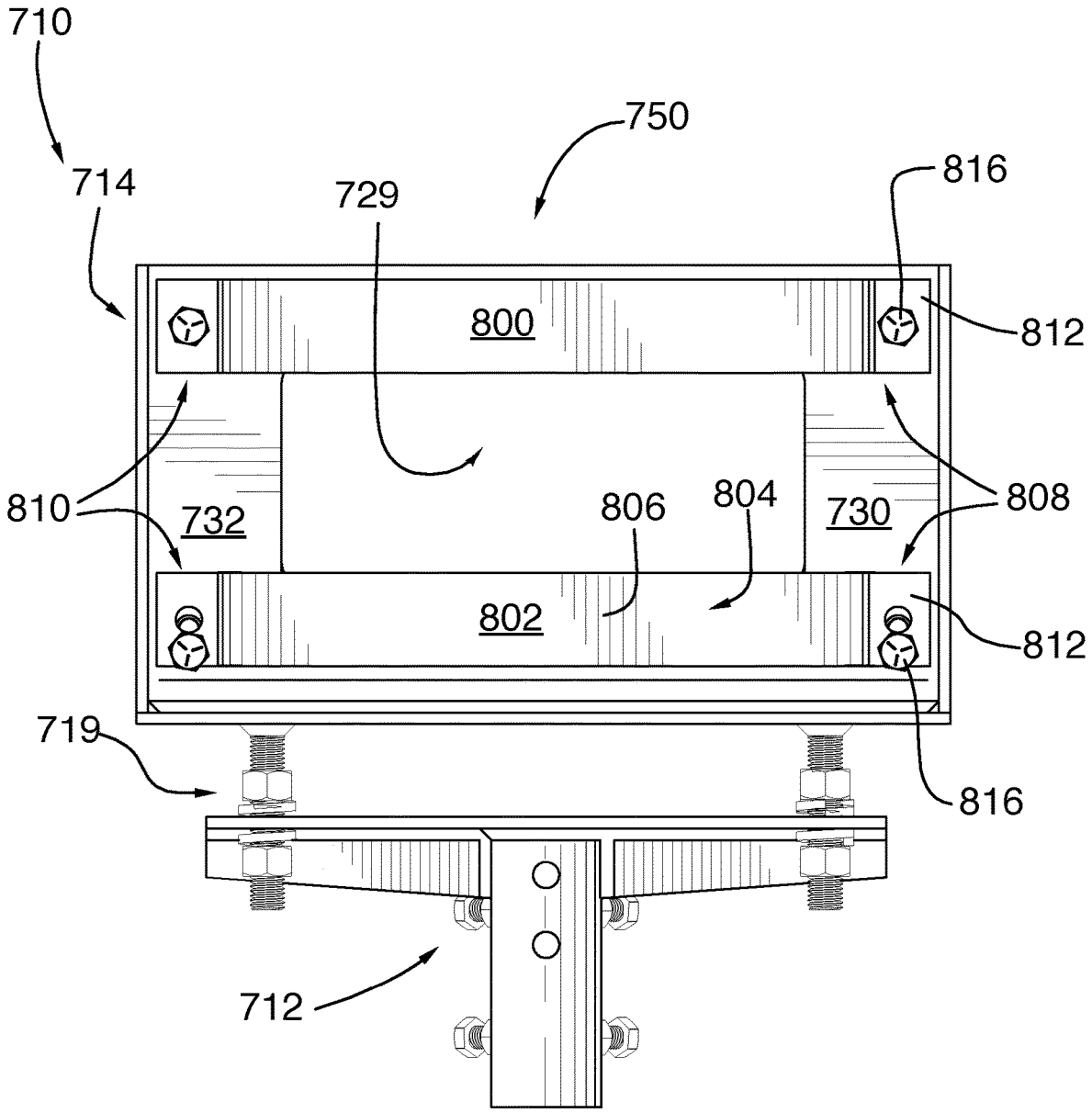
FIG. 12 is a front elevation view of the pile head illustrated in FIG. 11.
Figure 13:
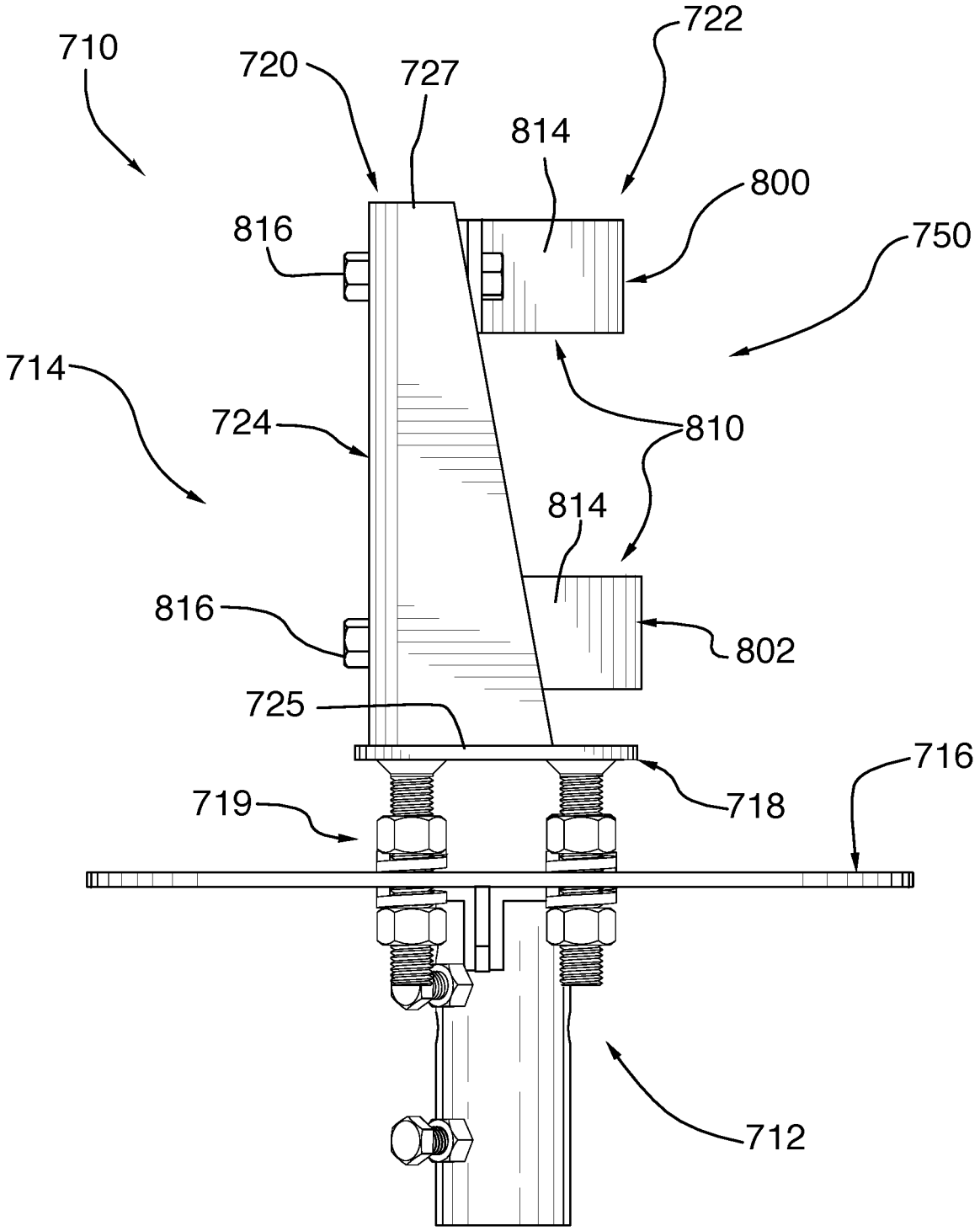
FIG. 13 is a right side elevation view of the pile head illustrated in FIG. 11.

Each jaw portion 800, 802 is further configured to be selectively movable towards and away from the central panel 724. More specifically, each jaw portion 800, 802 is connected to the central panel 724 by a pair of bolts 816, each of which extends through the end tab 812 of one of the connecting portions 808, 810 and through a corresponding side portion 730, 732 of the central panel 724. As best shown in FIG. 11, each bolt 816 is further aligned with and engages a nut which has been secured to the central panel 724 by welding or using any other securing techniques that a skilled addressee would consider appropriate.

Figure 14:
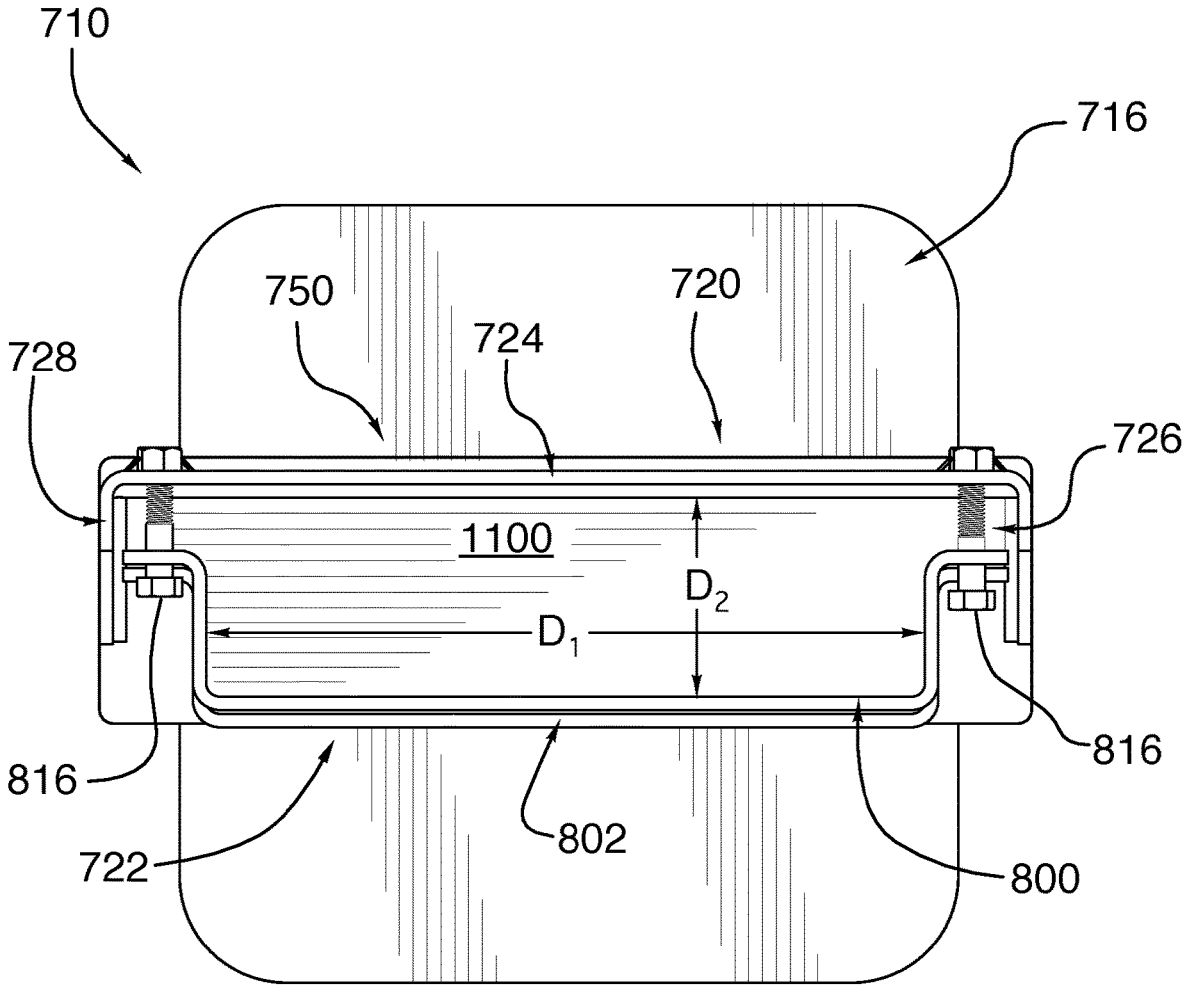
FIG. 14 is a top plan view of the pile head illustrated in FIG. 11.

As further shown in FIG. 14, a generally rectangular receiving space 1100 is defined between the upper and lower second jaw portions 800, 802 and the central panel 724. The receiving space 1100 is sized and shaped to receive the bottom portion of the headstone. More specifically, the distance $D_1$ between the intermediate panel portions 814 of each strap member 804 is generally similar to a width of the headstone's bottom portion. Furthermore, the distance $D_2$ between the central clamping portion 806 of the strap members 804 and the central panel 724 can be adjusted by tightening the bolts 816 until the central clamping portion 806 abuts the bottom portion of the headstone. The bolts 816 can further be tightened to apply pressure on the bottom portion of the headstone to further prevent movement of the headstone relative to the apparatus 700.

In this configuration, once the pile 702 is positioned and at least partially buried at its desired location, the headstone can simply be lowered into the receiving space 1100 and the bolts 816 can be tightened to move the second jaw member 722 towards the first jaw member 720 and thereby clamp the bottom portion 703 of the headstone 701 within the clamping assembly 750 to maintain the headstone 701 in a desired vertical orientation.

As it will be appreciated, the first jaw member 720, the second jaw member 722 and/or other components of the holding portion 714 could be provided with resilient material, such as a rubber material, facing toward the receiving space 1100, such that the resilient material is "sandwiched" between the first and/or second jaw members 720, 772 and the bottom portion 703 of the headstone 701, thereby contributing to avoid potential damages which could be caused causes by a direct contact between the metal material of the clamping portion 750 upon tightening of the bolts 816 to prevent movement of the headstone 701 relative to the apparatus 700.

Although the above description relates to a specific preferred embodiment as presently contemplated by the inventor, it will be understood that the invention in its broad aspect includes mechanical and functional equivalents of the elements described herein.

The invention claimed is:

1. A headstone and support assembly, comprising:

a headstone, the headstone having a bottom portion having a width $D_1$ and a depth $D_2$; and a support apparatus for supporting the headstone, the support apparatus having:

a pile having a top end and a bottom end, a helical member secured to the bottom end of the pile, and a pile head secured to the top end of the pile, the pile head having a mounting portion engaging the top end of the pile and a holding portion extending away from the mounting portion for engaging the bottom portion of the headstone to maintain the headstone in a vertical orientation, the holding portion of the pile head including a clamp assembly being shaped and adjustable in size along a dimension corresponding to the depth $D_2$ of the bottom portion of the headstone, for snuggly receiving and holding the bottom portion of the headstone, and the holding portion further including an upper positioning plate for supporting a bottom face of the headstone, and the clamp assembly including a first jaw member connected to the upper positioning plate and a second jaw member movably connected to the first jaw member.

2. The headstone and support assembly as claimed in claim 1, wherein the first jaw member includes a rectangular panel extending perpendicular to the upper positioning plate.

3. The headstone and support assembly as claimed in claim 2, wherein the rectangular panel includes a central rectangular opening.

4. The headstone and support assembly as claimed in claim 1, wherein the second jaw member includes an upper second jaw portion and a lower second jaw portion spaced from the upper second jaw portion.

5. The headstone and support assembly as claimed in claim 4, wherein each second jaw portion includes an elongated band extending parallel to the first jaw member.

6. The headstone and support assembly as claimed in claim 5, wherein the first jaw member includes a first side portion and a second side portion, and wherein each second jaw portion includes a first connecting portion connected to the first side portion of the first jaw member, a second connecting portion connected to the second side portion of the first jaw member and a central clamping portion extending between the first and second connecting portions.

7. The headstone and support assembly as claimed in claim 6, wherein the central clamping portion is spaced from the first jaw member to define a receiving recess therebetween, the receiving recess being sized and shaped to receive the bottom end of the headstone.

8. A method of supporting a headstone, comprising:

inserting a pile a of a headstone support apparatus into a ground, the pile having a helical member secured to the bottom end of the pile, the headstone support apparatus including the pile, a pile head secured to the top end of the pile, the pile head having a clamp assembly being shaped and adjustable in size along a dimension corresponding to a depth $D_2$ of a bottom portion of the headstone for snuggly receiving and holding the bottom portion of the headstone, and the holding portion further including an upper positioning plate for supporting a bottom face of the headstone, and the clamp assembly including a first jaw member connected to the upper positioning plate and a second jaw member movably connected to the first jaw member;

inserting the bottom portion of the headstone into the clamp assembly; and adjusting the size of the clamp assembly to snuggly receive and hold the bottom portion of the headstone.

9. The headstone and support assembly as claimed in claim 1, wherein: the mounting portion of the pile head includes a sleeve having an open first end for receiving the top end of the pile and a closed second end, the sleeve defining a longitudinal axis; and a lower positioning plate secured to the second end of the sleeve and extending orthogonally to the longitudinal axis; and the holding portion of the pile head includes an upper positioning plate spaced apart from the lower positioning plate, away from the pile, and a connection assembly connecting the upper positioning plate to the lower positioning plate, the connection assembly being configured to maintain the upper positioning plate at a desired distance and angle from the lower positioning plate.

10. The headstone and support assembly as claimed in claim 9, wherein the connection assembly includes at least one threaded rod, each threaded rod having an upper end secured to the upper positioning plate and a lower end engaging a corresponding receiving hole defined in the lower positioning plate.

11. The headstone and support assembly as claimed in claim 10, wherein the at least one threaded rod includes four threaded rods disposed generally orthogonally to the lower and upper positioning plates.

12. The headstone and support assembly as claimed in claim 11, wherein the upper positioning plate is rectangular, and further wherein the upper end of each threaded rod is secured to a corresponding corner of the upper positioning plate.

13. The headstone and support assembly as claimed in claim 10, wherein the connection assembly further includes at least one nut threadably engaging the threaded rod for fastening the lower positioning plate to the lower end of the at least one threaded rod.

14. The headstone and support assembly as claimed in claim 13, wherein the at least one nut includes a pair of nuts spaced apart to receive and hold the lower positioning plate therebetween.

15. The headstone and support assembly as claimed in claim 14, wherein the connection assembly further includes at least one split washer disposed between the at least one nut and the lower positioning plate to prevent rotation of the at least one nut relative to the lower positioning plate.

16. The headstone and support assembly as claimed in claim 10, wherein the receiving holes of the lower positioning plate are oblong to allow lateral adjustment of the upper positioning plate relative to the lower positioning plate.

* * * * *